US011389046B2

(12) United States Patent
Michal

(10) Patent No.: US 11,389,046 B2
(45) Date of Patent: Jul. 19, 2022

(54) FOLD AWAY CUTLERY RACK

(71) Applicant: ELECTROLUX HOME PRODUCTS, INC., Charlotte, NC (US)

(72) Inventor: Justin D. Michal, Myrtle Beach, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 833 days.

(21) Appl. No.: 16/089,484

(22) PCT Filed: Apr. 8, 2016

(86) PCT No.: PCT/US2016/026704
§ 371 (c)(1),
(2) Date: Sep. 28, 2018

(87) PCT Pub. No.: WO2017/176286
PCT Pub. Date: Oct. 12, 2017

(65) Prior Publication Data

US 2020/0297182 A1 Sep. 24, 2020

(51) Int. Cl.
*A47L 15/50* (2006.01)

(52) U.S. Cl.
CPC ..... *A47L 15/503* (2013.01); *A47L 15/502* (2013.01)

(58) Field of Classification Search
None
See application file for complete search history.

(56) References Cited

U.S. PATENT DOCUMENTS 5,462,348 A * 10/1995 Ellingson ..... A47L 15/502 312/301
8,701,898 B2 4/2014 Chai
(Continued)

FOREIGN PATENT DOCUMENTS

CN 102058368 A 5/2011
CN 102469910 A 5/2012
(Continued)

OTHER PUBLICATIONS

Extended European Search Report for European Patent Application No. 16898123.1, dated Jan. 2, 2020, (9 pages), European Patent Office, Munich, Germany.
(Continued)

*Primary Examiner* — Michael E Barr
*Assistant Examiner* — Omair Chaudhri
(74) *Attorney, Agent, or Firm* — RatnerPrestia

(57) ABSTRACT

Provided herein are cutlery racks, dishwashers, and associated methods for manufacturing and cleaning with the same. The dishwasher may include a cutlery rack having a first engaging portion, a second engaging portion, and a shelf. The first and second engaging portions may be respectively slidably attached to a first wall and a second wall of a dishwasher rack. The shelf may extend between the first engaging portion and the second engaging portion, may slide in a longitudinal direction with respect to the first wall and the second wall, and may pivot with respect to the dishwasher rack between a working position and a stowed position. In the working position, a receiving surface of the shelf may align with the longitudinal direction, and in the stowed position, the receiving surface shelf may be pivoted out of alignment with the longitudinal direction and positioned adjacent ends of the first and second walls.

14 Claims, 2 Drawing Sheets

(56) References Cited

U.S. PATENT DOCUMENTS

| | | | | |
|---|---|---|---|---|
| 9,161,677 | B2 | 10/2015 | Hofpeter et al. | |
| 2012/0139400 | A1 * | 6/2012 | Hofpeter | A47L 15/502 312/228.1 |
| 2013/0002107 | A1 * | 1/2013 | Paschini | A47L 15/502 312/228.1 |
| 2013/0247944 | A1 | 9/2013 | Fischer et al. | |
| 2013/0257113 | A1 | 10/2013 | Seibold et al. | |

FOREIGN PATENT DOCUMENTS

| | | | | |
|---|---|---|---|---|
| CN | 103402813 | A | 11/2013 | |
| DE | 3520148 | A1 | 12/1986 | |
| DE | 4309915 | A1 | 9/1994 | |
| DE | 4309915 | A1 * | 9/1994 | A47L 15/502 |
| DE | 29618924 | U1 | 2/1998 | |
| DE | 29621528 | U1 | 4/1998 | |
| DE | 19935312 | C2 | 4/2003 | |
| DE | 102009028035 | A1 | 2/2011 | |
| DE | 102013103707 | A1 | 10/2014 | |
| DE | 102013103707 | A1 * | 10/2014 | A47L 15/502 |
| EP | 0385877 | B1 * | 8/1993 | A47L 15/502 |
| EP | 1275336 | A1 | 1/2003 | |
| EP | 1275336 | A1 * | 1/2003 | A47L 15/502 |
| EP | 1475030 | A2 | 11/2004 | |
| EP | 1384432 | B1 | 9/2012 | |
| EP | 2554097 | A2 | 2/2013 | |
| EP | 2322074 | B1 | 3/2013 | |
| EP | 2292140 | B1 | 5/2014 | |
| EP | 2941172 | B1 * | 3/2017 | A47L 15/502 |
| EP | 2941172 | B1 | 3/2017 | |
| EP | 3089647 | B1 * | 3/2018 | A47L 15/505 |
| GB | 2410419 | B | 6/2006 | |
| WO | WO-2013053720 | A1 * | 4/2013 | A47L 15/503 |
| WO | WO-2013/098009 | A1 | 7/2013 | |
| WO | WO 2014/102744 | A1 | 7/2014 | |
| WO | WO 2015/101877 | A1 | 7/2015 | |
| WO | WO 2015/101879 | A1 | 7/2015 | |

OTHER PUBLICATIONS

1st Office Action and Search Report for China Application 201680085516.8 dated Nov. 19, 2020 with Englsh Translation (21 pages).

International Searching Authority, International Search Report and Written Opinion for International Application No. PCT/US2016/026704, dated Jun. 30, 2016, 11 pages, United States Patent and Trademark Office, U.S.A.

AEG Comfort Lift Airdry Technology Built-in Fullsize Dish Washer FSS62800P Datasheet, 1 page, retrieved from <https://www.aeg.co.uk/kitchen/dishwashing/dishwashers/built-in-dishwasher/fss62800p/> on Sep. 12, 2018.

AEG Comfort Lift Airdry Technology Built-in Fullsize Dish Washer FSS62800P Product Information Sheet, 1 page, retrieved from <https://productinformation.electrolux.com/EdenService.svc/WEB/GetPFAndEcoDesign/productid=B82BE26C-BEE4-4CB0-A7C0-77F8BDE9F079/languageisocode=en-gb/format=PDF> on Sep. 12, 2018.

Chinese Office Action for Chinese Application No. 201680085516.8, dated May 11, 2022, with translation, 21 pages.

* cited by examiner

FOLD AWAY CUTLERY RACK

CROSS REFERENCE TO RELATED APPLICATIONS

This application is a National Stage Application, filed under 35 U.S.C. § 371, of International Application No. PCT/US2016/026704, filed Apr. 8, 2016; the contents of which are hereby incorporated by reference in their entirety.

BACKGROUND

Related Field

Embodiments of the present invention relate generally to dishwashers and, more particularly, to cutlery racks for dishwashers and dishwashers comprising at least one cutlery rack.

Description of Related Art

Dishwashers are often provided with a cutlery basket or a cutlery tray for stacking cutlery pieces. Traditionally, cutlery baskets may be detachably arranged within the lower rack of the dishwasher, and arranged for essentially vertical reception of cutlery. However, these baskets occupy space in the bottom of the lower rack or must be removed and stored outside the dishwasher. Cutlery trays may be arranged for substantially horizontal reception of cutlery, and are adapted to be extractably arranged in the dishwasher, e.g. attached to the wall or top of the tub in the upper part of the dishwasher, above the upper rack. These cutlery trays also occupy substantial vertical space in the tub, even when not in use.

Applicant has identified a number of deficiencies and problems associated with conventional dishwasher cutlery racks and other associated systems and methods. Through applied effort, ingenuity, and innovation, many of these identified problems have been solved by developing solutions that are included in embodiments of the present invention, many examples of which are described in detail herein.

BRIEF SUMMARY

Generally, some embodiments provided herein include dishwashers, cutlery racks, and associated methods. The dishwasher may include a dishwasher rack disposed in the dishwasher. The dishwasher rack may comprise at least a first wall and a second wall. The first wall may be parallel to the second wall, and each of the first wall and the second wall may define at least one end. The dishwasher may further include a cutlery rack comprising a first engaging portion. The first engaging portion of the cutlery rack may be slidably attached to the first wall of the dishwasher rack. The cutlery rack may include a second engaging portion, and the second engaging portion of the cutlery rack may be slidably attached to the second wall of the dishwasher rack. The cutlery rack may further include a shelf extending between the first engaging portion and the second engaging portion. The shelf may define a receiving surface for receiving cutlery. The shelf may be configured to slide in a longitudinal direction with respect to the first wall and the second wall, and the shelf may be configured to pivot with respect to the dishwasher rack between a working position and a stowed position. In the working position, the receiving surface of the shelf may be aligned with the longitudinal direction. In the stowed position, the receiving surface shelf may be pivoted out of alignment with the longitudinal direction and may be positioned adjacent an end of the first wall and an end of the second wall.

In some embodiments, the first engaging portion and the second engaging portion may be disposed on a first side of the cutlery rack. The first engaging portion may define a first pivotal attachment member engaging a first rail on the first wall of the dishwasher rack, and the second engaging portion may define a second pivotal attachment member engaging a second rail on the second wall of the dishwasher rack. The cutlery rack may further comprise a second side comprising a third engaging portion configured to be removably and slidably disposed on the first rail in the working position and a fourth engaging portion configured to be removably and slidably disposed on the second rail in the working position. The cutlery rack may be configured to slide along the first rail on the first engaging portion and the third engaging portion and the cutlery rack may be configured to slide along the second rail on the second engaging portion and the fourth engaging portion. The cutlery rack may be configured to be pivoted to the stowed position by lifting the second side of the cutlery rack and rotating the cutlery rack about a first pivotal attachment member of the first engaging portion and a second pivotal attachment member of the second engaging portion.

In some embodiments, in the working position, the receiving surface of the shelf may be configured to be disposed generally parallel to the longitudinal direction. In the stowed position, the receiving surface of the shelf may be configured to be disposed generally perpendicular to the longitudinal direction.

The first wall may further comprise a first rail disposed on an upper edge of the first wall. The first rail may at least partially define a first receiving slot. The first receiving slot may extend parallel to the longitudinal direction, and the first engaging portion may be configured to engage the first receiving slot. In some embodiments, the first engaging portion may include a first leg attached generally perpendicular to the shelf, the first leg defining a length. The first receiving slot may terminate at a distance from the end of the first wall of the dishwasher rack, and the distance may be equal to the length of the first leg.

In some embodiments, the second wall may further comprise a second rail disposed on an upper edge of the second wall. The second rail may at least partially define a second receiving slot. The second receiving slot may extend parallel to the longitudinal direction, and the second engaging portion may be configured to engage the second receiving slot.

The second engaging portion may comprise a second leg attached generally perpendicular to the shelf, the second leg defining the length. The second receiving slot may terminate at the distance from the end of the second wall of the dishwasher rack.

In some embodiments, the cutlery rack may further comprise a third engaging portion attached to the shelf and a fourth engaging portion attached to the shelf. The third engaging portion may be configured to engage the first wall in the working position, and the fourth engaging portion may be configured to engage the second wall in the working position.

The first engaging portion may define a first slot configured to receive at least a portion of the first wall therein. The first engaging portion may further comprise a first attachment member extending across the first slot, such that the first engaging portion may at least partially surround the portion of the first wall.

The second engaging portion may define a second slot configured to receive at least a portion of the second wall therein. The second engaging portion may further comprise a second attachment member extending across the second slot, such that the second engaging portion may at least partially surround the portion of the second wall. In some embodiments, the shelf may be configured to pivot about an axis spanning the first attachment member and the second attachment member.

In some embodiments, in the stowed position, a portion of the shelf is configured to rest on an upper edge of a third wall of the dishwasher rack, and the third wall may extend between the end of the first wall and the end of the second wall.

The shelf, the first engaging portion, and the second engaging portion may be fixedly connected to each other, and the shelf may be configured to pivot about an axis extending between the first engaging portion and the second engaging portion.

In another embodiment, a cutlery rack may be provided. The cutlery rack may include a first side and a second side. The first side may comprise a first engaging portion configured to pivotally and slidably attach to a first rail of a first wall of a dishwasher rack. The first engaging portion may define a first pivotal attachment member configured to engage the first rail. The first side may include a second engaging portion configured to pivotally and slidably attach to a second rail of a second wall of a dishwasher rack. The second engaging portion may define a second pivotal attachment member configured to engage the second rail. The second side may comprise a third engaging portion configured to be removably and slidably disposed on the first rail and a fourth engaging portion configured to be removably and slidably disposed on the second rail. The cutlery rack may be configured to slide along the first rail on the first engaging portion and the third engaging portion and the cutlery rack may be configured to slide along the second rail on the second engaging portion and the fourth engaging portion. The cutlery rack may be configured to be pivoted to a stowed position by lifting the second side of the cutlery rack and rotating the cutlery rack about the first pivotal attachment member of the first engaging portion and the second pivotal attachment member of the second engaging portion.

In some embodiments, the cutlery rack may comprise a shelf extending between the first side and the second side, the shelf defining a receiving surface for receiving cutlery. The first engaging portion may comprise a first leg attached generally perpendicular to the shelf, the first leg defining a length. The length may be configured to be equal to a distance a termination point of a first receiving slot defined by the first rail and an end of the first wall.

In some embodiments, the second engaging portion may comprise a second leg attached generally perpendicular to the shelf, the second leg defining the length.

The first engaging portion may define a first slot configured to receive the first rail. In some embodiments, the first attachment member may extend across the first slot, such that the first engaging portion may be configured to at least partially surround the first rail. The second engaging portion may define a second slot configured to receive the second rail, and the second attachment member may extend across the second slot, such that the second engaging portion may be configured to at least partially surround the second rail.

In yet another embodiment, a method of manufacturing a dishwasher with a cutlery rack is provided. The dishwasher may include a dishwasher rack disposed in the dishwasher. The dishwasher rack may comprise at least a first wall and a second wall. The first wall may be parallel to the second wall, and each of the first wall and the second wall may define at least one end. The dishwasher may further include a cutlery rack comprising a first engaging portion, a second engaging portion, and a shelf extending between the first engaging portion and the second engaging portion. The shelf may define a receiving surface for receiving cutlery. The method may include attaching the first engaging portion of the cutlery rack to the first wall of the dishwasher rack. After attachment, the first engaging portion may be configured to slide relative to the first wall of the dishwasher rack. The method may further include attaching the second engaging portion of the cutlery rack to the second wall of the dishwasher rack. After attachment, the second engaging portion may be configured to slide relative to the second wall of the dishwasher rack. The shelf may be configured to slide in a longitudinal direction with respect to the first wall and the second wall. The shelf may be configured to pivot with respect to the dishwasher rack between a working position and a stowed position. In the working position, the receiving surface of the shelf may be aligned with the longitudinal direction. In the stowed position, the receiving surface shelf may be pivoted out of alignment with the longitudinal direction and positioned adjacent an end of the first wall and an end of the second wall.

BRIEF DESCRIPTION OF THE FIGURES

Figure 1:
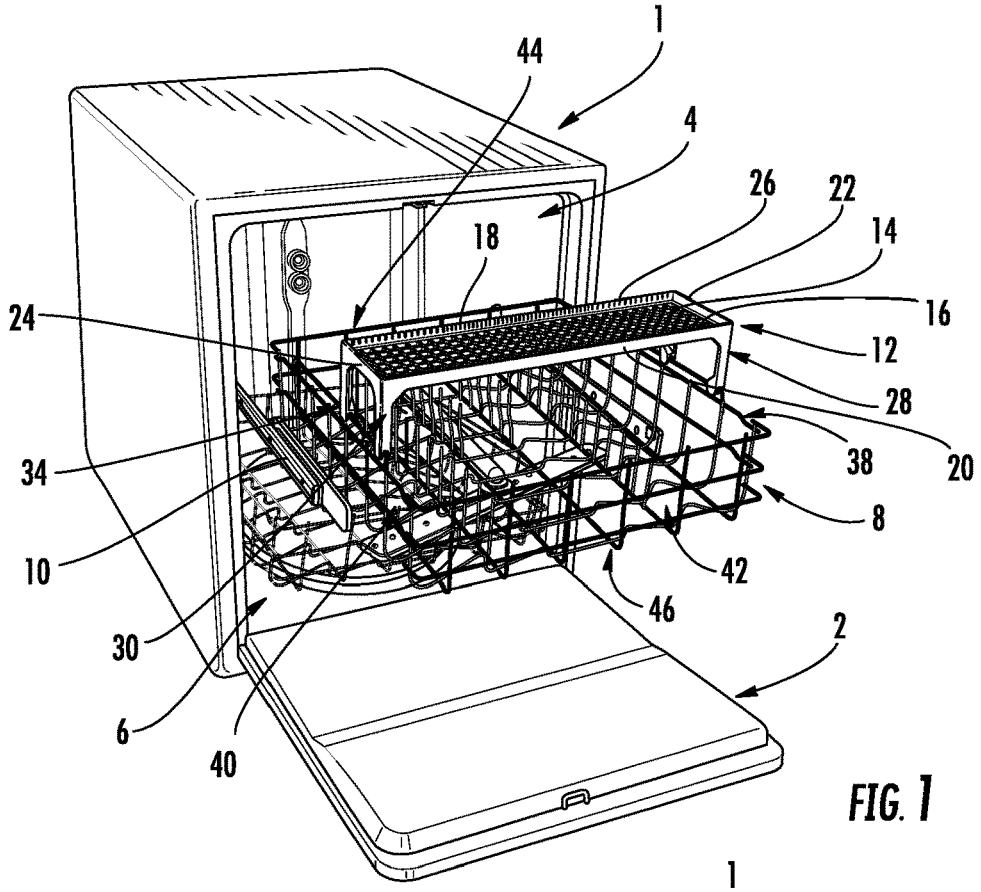
Figure 2:
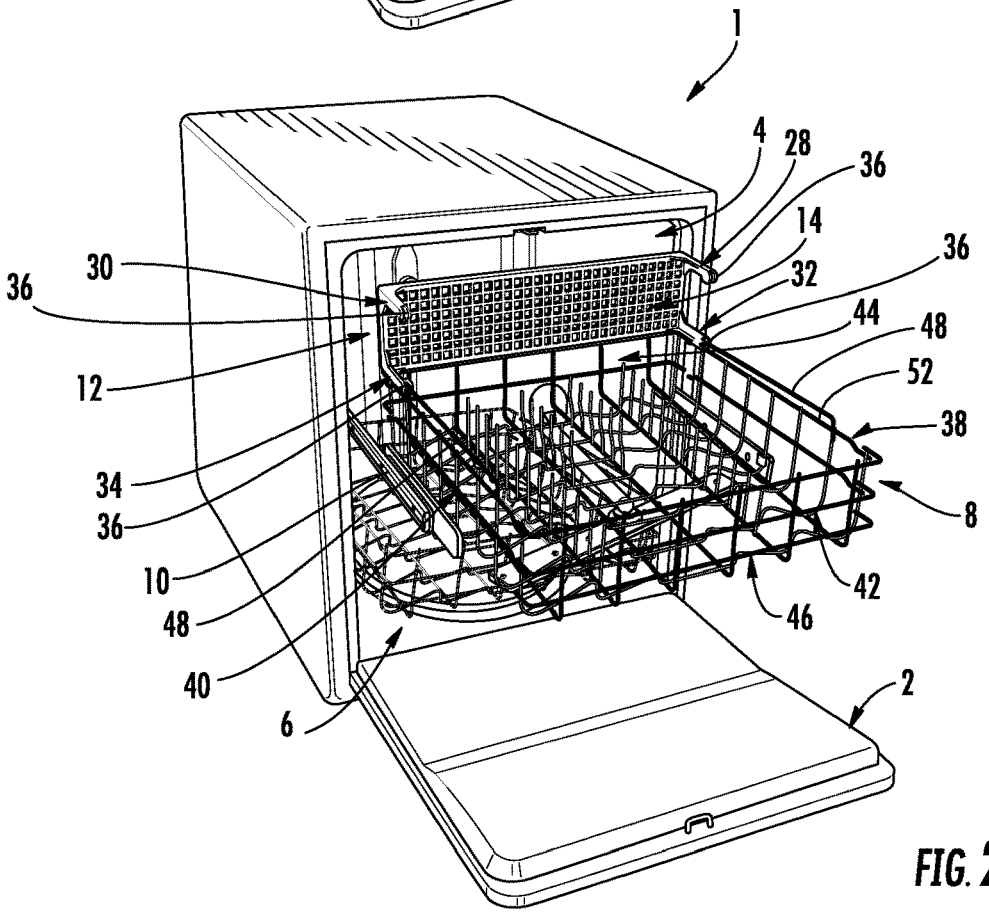
Figure 3:
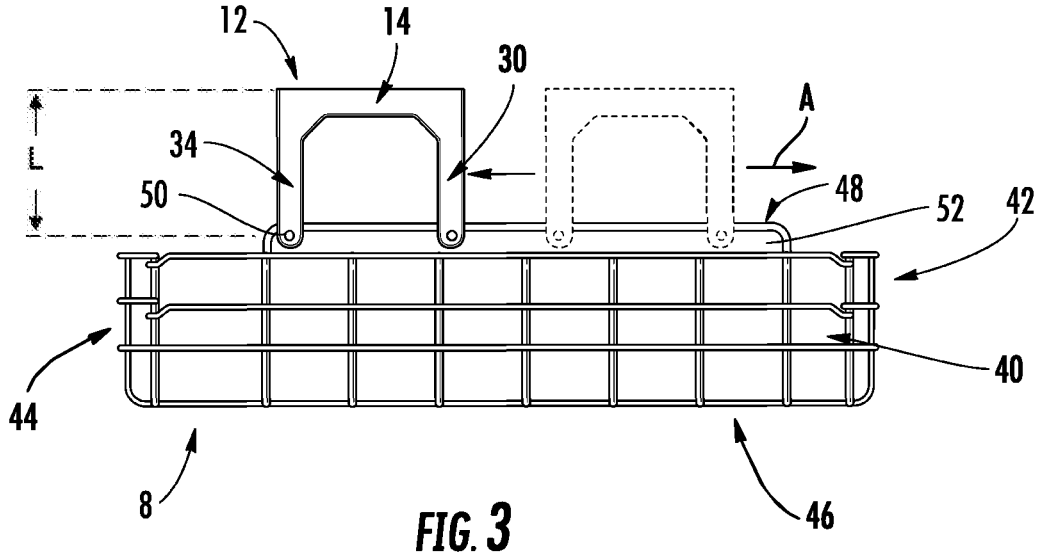
Figure 4:
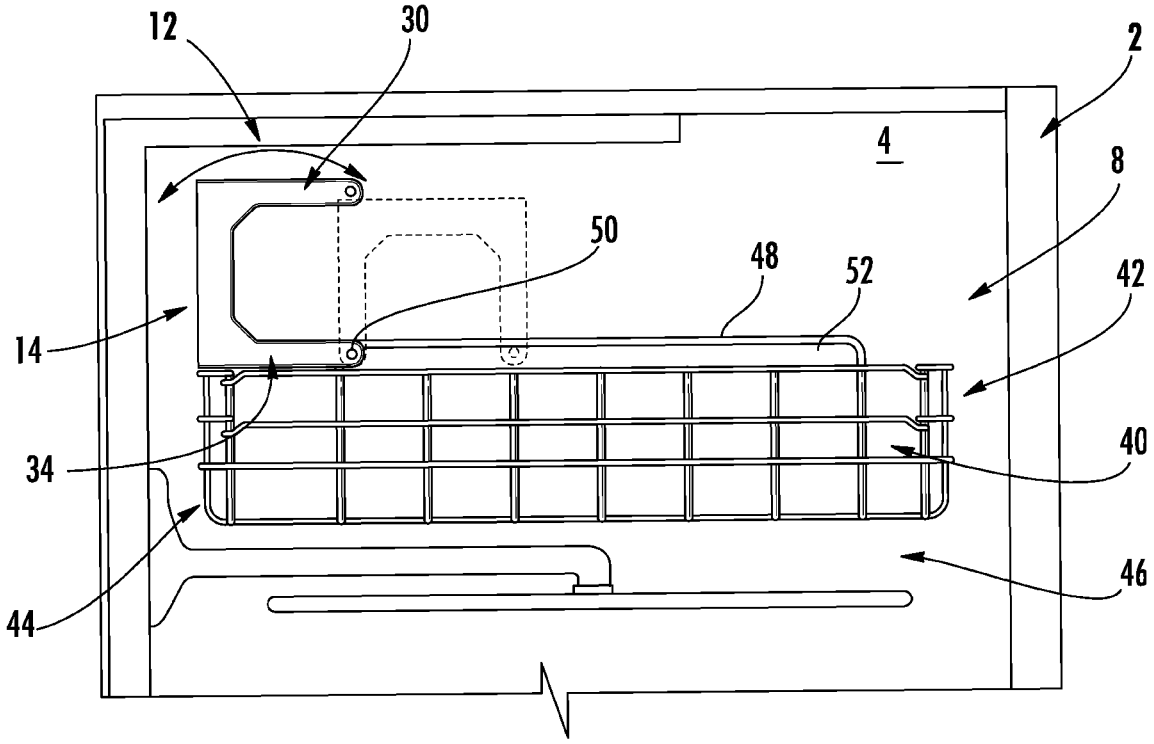

Having thus described the invention in general terms, reference will now be made to the accompanying drawings, which are not necessarily drawn to scale, and wherein:

FIG. 1 shows a dishwasher having a cutlery rack in a working position according to some embodiments discussed herein;

FIG. 2 shows the dishwasher of FIG. 1 having the cutlery rack in a stowed position according to some embodiments discussed herein;

FIG. 3 shows a cutlery rack in a working position according to some embodiments discussed herein; and FIG. 4 shows a cutlery rack moving between a working position and a stowed position according to some embodiments discussed herein.

DETAILED DESCRIPTION OF VARIOUS EMBODIMENTS

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein; rather, these embodiments are provided so that this disclosure will satisfy applicable legal requirements. Like reference numerals refer to like elements throughout.

Dishwashers often include dedicated receiving areas for washing cutlery. Cutlery, including knives, forks, spoons, and the like, often has smaller dimensions than traditional dishware and, thus, may fall through the relatively larger openings of a dishwasher rack. Moreover, cutlery includes many, smaller surfaces, which warrant specific positioning in the wash chamber and/or higher spray intensities to ensure that the cutlery is cleaned thoroughly.

Some embodiments discussed herein include an improved cutlery rack that offers space and organization for cutlery, while also obstructing as little of the wash chamber as possible without requiring disassembly or storage. As detailed herein, a cutlery rack may be provided that is slidably attached to a dishwasher rack (e.g., the middle rack of a three-rack dishwasher or the top rack of a two-rack dishwasher), wherein the cutlery tray includes a detachable front connection and is designed to pivot to a vertical stowed position that is aligned with and proximate the back wall of the dishwasher tub when in non-use.

With reference to FIG. 1, a dishwasher 1 is shown in accordance with some embodiments discussed herein. The depicted dishwasher 1 includes a door 2 and a wash chamber 4 in which various articles, including cutlery, may be positioned for cleaning. The depicted embodiment includes a lower dish rack 6 and a middle dish rack 8, each configured to hold crockery, including plates, dishes, cups, pans, and the like, for washing. The dish racks 6, 8 may be movable on rails 10 from a loading position, outside the wash chamber 4, to a working position in the wash chamber.

The embodiment shown in FIGS. 1-2 further includes a cutlery rack 12 disposed on the middle rack 8 of the dishwasher for holding cutlery to be cleaned. The cutlery rack includes a shelf 14 having a receiving surface 16 that may include a grid of support bars. In some embodiments, adjacent, parallel grid bars may be spaced one half inch from each other, defining half inch square holes in the grid. The shelf 14 may include raised side walls 18, 20, 22, 24 surrounding the receiving surface 16 for supporting and containing cutlery on the receiving surface of the shelf. For example, the walls 18, 20, 22, 24 may prevent items lying on the shelf from inadvertently falling into the spray arms or sump of the dishwasher during a wash cycle. In some embodiments, the cutlery rack 12 may be disposed on a lower dish rack 6.

In some embodiments, one or more of the raised side walls 18, 20, 22, 24 may include one or more holders 26 (e.g., grooves, slots, openings, or other holding features) for supporting and securing cutlery. For example, in the embodiment shown in FIGS. 1-2, the shelf 14 includes a plurality of holders 26 spaced along the rear wall 18. These holders 26 may be evenly spaced, or may include variable spacing. For example, in the depicted embodiment of FIG. 1, the holders 26 at outer ends of the rear wall 18 include wider spacing than near a center portion of the rear wall (e.g., outer thirds of the rear wall 18 may include wider spacing than a center third of the rear wall). In other embodiments, either half of any wall 18, 20, 22, 24 of the shelf 14 may include holders 26 at a wider spacing than the other half. One of ordinary skill in the art will appreciate, in view of the present disclosure, that any configuration of additional holders, such as clips, specialized openings, raised prongs, and the like may be disposed on the shelf to organize and support cutlery.

In some embodiments, the shelf 14 may define a width corresponding to the width of the dishwasher rack. For example, in some embodiments, the width of the shelf 14 may be from 18 inches to 20 inches. For example, the width of the shelf 14 may be 18.41 inches (~467.54 mm). In some embodiments, the length of the shelf 14 in the longitudinal direction A may be from 4 inches to 5 inches. For example, the length of the shelf 14 may be 4.88 inches (~124 mm). In some embodiments, the walls 20, 22, 24, 26 of the shelf 14 may be between half an inch and 1.5 inches tall. For example, the height of the walls 20, 22, 24, 26 of the shelf 14 may be 0.71 inches (~18 mm).

With reference to FIGS. 1-4, the shelf 14 may include one or more engaging portions 28, 30, 32, 34 that connect the shelf to the dishwasher rack 8. In the depicted embodiment, the engaging portions 28, 30, 32, 34 include four legs extending perpendicularly downward from the shelf to engage the dishwasher rack 8. The engaging portions 28, 30, 32, 34 may engage two or more walls 38, 40, 42, 44 of the dishwasher rack 8. In some embodiments, as shown in FIGS. 1-4, the cutlery rack 12 may engage and slide along rails 48, on two parallel walls (e.g., first side wall 38 and second side wall 40). As used herein, the "walls" do not require a solid or continuous surface, but rather, encompass structures that generally align in different regions of the dishwasher rack 8 and/or cutlery rack 12. For example, the depicted "rear wall" 44 may include a plurality of horizontal and/or vertical grid bars along a rear of the dishwasher rack 8. Each wall 38, 40, 42, 44 may define two ends, an upper edge and a lower edge (e.g., two ends of the second wall 40 are shown at the left and right extremes of the wall in the longitudinal direction A of FIGS. 3-4, with the upper edge shown at the top side of the wall 40 and the lower edge shown at the bottom side of the wall 40 in FIGS. 3-4).

The depicted rails 48 are defined on a top edge of the first side wall 38 and the second side wall 40, such that slots 36 of the engaging portions 28, 30, 32, 34 may slide along the rails at an uppermost edge of the side walls. As detailed below, the rails 48 may define longitudinal receiving slots 52 between the rail and the remainder of the walls (e.g., first side wall 38 and second side wall 40). In some embodiments, the engaging portions may ride on rails disposed on an outside or inside surface of the dishwasher rack walls, and the rails may be disposed at an uppermost edge of the walls or at some intermediate position on the side walls. One of ordinary skill in the art will further appreciate, in light of the present disclosure, that the cutlery rack may ride along any parallel walls of the dishwasher rack (e.g., the first and second side walls 38, 40 or the front and rear walls 42, 44), or the cutlery rack may attach to the bottom 46 of the dishwasher rack.

The shelf 14 may be positioned above the dishwasher rack 8 by the engaging portions 28, 30, 32, 34 to allow sufficient space for crockery in the middle dishwasher rack 8. For example, the shelf 14 may be positioned higher than a wine glass, which may be positioned on the dishwasher rack 8 below. The engaging portions 28, 30, 32, 34 may each define a length L from the attachment members 50, which may engage the underside of the rails 48 in the receiving slot 52, to the top of the side walls 20, 22, 24, 26 of the shelf 14. The sum of the length L and the height of the respective wall 38, 40, 42, 44 from the bottom 46 of the dishwasher rack 8 to the attachment members 50 may define the maximum height of the crockery that may be positioned in the dishwasher rack. In some embodiments, the length may be from 3 inches to 5 inches. For example, the length L may be approximately 3.78 inches (~96.05 mm) in some embodiments. In some embodiments, the length L may be zero, such that the shelf 14 is generally level with the rail 48. In some embodiments, the shelf 14 may rest on the rails 48, and the engaging portions 28, 30, 32, 34 may define slots, bumpers, abutment mechanisms, or other attachment devices for attaching the shelf directly to the rails. In some embodiments, the engaging portions may define a width, perpendicular to the longitudinal direction, of approximately 0.6 inches (~15 mm).

One or more of the engaging portions 28, 30, 32, 34 may attach to the walls of the dishwasher rack 8 to allow pivotal and sliding movement of the shelf 14 relative to the rack, while limiting or preventing removal of the cutlery rack 12 from the dishwasher rack. In the depicted embodiment, the rear engaging portions 32, 34 attach to the rack 8, while the front engaging portions 28, 30 removably engage the dishwasher rack, such as by resting on the rack or loosely gripping the dishwasher rack in a working position. The depicted engaging portions 28, 30, 32, 34 include the slots 36 at a distal end of the legs for receiving a portion of the side walls (e.g., rails 48 of one or more of the walls 38, 40, 42, 44) therein. The depicted rear engaging portions 32, 34 further include attachment members 50 (e.g., pins, clips, pegs, bolts, or the like) extending across the slots 36 to hold the cutlery rack 12 on the rails 48. In such embodiments, the engaging portions 32, 34 having the attachment members 50 may be on a first side of the cutlery rack 12 and the engaging portions 28, 30 removably and slidably resting on the rails 48 without an attachment member may be on a second side of the cutlery rack 12.

The rails 48 may define a continuous, longitudinal receiving slot 52 in which the attachment members 50 may slide. The receiving slots 52 may allow the rear engaging portions 32, 34 on the first side to remain attached to the dishwasher rack 8 while being pivotable and slidable relative to the dishwasher rack. In some embodiments, the rails may be from 12 to 14 inches long (e.g., 12.62 inches or 320.55 mm), and the rails may be from one half inch to 1.5 inches tall (e.g., 0.65 inches or 16.53 mm) above the upper edge of the respective walls 38, 40, 42, 44.

In some embodiments, the slots 36 and attachment members 50 (shown in FIGS. 3-4) may combine to surround the rails 48 on a cross-sectional plane. In some other embodiments, the engaging portions may hold the rails without completely surrounding them (e.g., via an open-ended pin extending in the receiving slots 52). In some embodiments, the slots 36 and/or attachment members 50 may be removably attached to the rails 48 (e.g., via removable pin, latch, open-ended pin, or the like), such that the cutlery rack 12 remains attached to the dishwasher rack 8 in normal operation, while also being detachable for cleaning or replacement.

Turning to the embodiment shown in FIGS. 3-4, a dishwasher rack 8 is shown from a right-side view, depicting the second wall 40 of the rack as coplanar with the page. While FIGS. 3-4 depict the structure of the dishwasher and cutlery rack 12 as viewed from the right side, one of ordinary skill in the art will appreciate that the descriptions of FIGS. 3-4 may be applied to the left-side structure in the same manner. In operation, with reference to FIG. 3, the cutlery rack 12 may slide along the dishwasher rack 8 in a longitudinal direction A of the walls to which the cutlery rack is engaged (e.g., first side wall 38 and second side wall 40). For example, the depicted embodiment of the cutlery rack 12 slides left-to-right in the longitudinal direction A along the rails 48 of the upper edge of the side walls 38, 40 of the dishwasher rack 8, generally parallel to the bottom 46 of the dishwasher rack. In this manner, the cutlery rack 12 may be positioned at any desired position along the rails 48 to allow the user to choose the relative positioning of the cutlery in the wash chamber 4 (shown in FIGS. 1-2) and the crockery in the dishwasher rack 8. Similarly, the slidable movement of the cutlery rack 12 may allow the user to load the cutlery rack at a front of the dishwasher rack 8 (e.g., proximate the front wall 42 of the dishwasher rack 8), and subsequently move the loaded cutlery rack to the rear (e.g., proximate the rear wall 44 of the dishwasher rack 8) for loading the dishwasher basket and/or for washing operations.

Turning to FIG. 4, the cutlery rack 12 may further pivot between a working position (shown in dashed line), in which the shelf 14 is positioned to accept cutlery, and a stowed position (showed in solid line), in which the shelf is positioned so as to avoid interfering with the operation of the dishwasher rack 8. In the depicted embodiment, the cutlery rack 12 pivots about an axis spanning the attachment members 50 of the rear engaging portions 32, 34. The front engaging portions 28, 30 on the second side may rest on a portion of the side walls 38, 40 (e.g., the rail 48) in the working position, and the front engaging portions may disconnect from the side walls 38, 40 in the stowed position. One of ordinary skill in the art will appreciate that the front engaging portions may instead be attached to the walls and may pivot with respect to the dishwasher rack. In such embodiments, the shelf may pivot forward in the stowed position. In some embodiments, the cutlery rack 12 may be configured to slide on parallel front and rear walls 42, 44, and the cutlery rack may pivot to the stowed position at or proximate the first side wall 38 or the second side wall 40.

With continued reference to FIGS. 3-4, the working position may be defined as an in-use position in which the receiving surface 16 of the shelf 14 is at least partially horizontal within the wash chamber 4 (shown in FIGS. 1, 2, and 4). In such embodiments, the receiving surface 16 of the shelf 14 may align with the longitudinal direction A. For example, the receiving surface 16 of the shelf 14 may be generally parallel with a plane spanning the longitudinal direction A of the respective walls on which the cutlery rack slides. For example, in the embodiment shown in FIG. 4, the working position is shown parallel with the longitudinal direction A of the second wall 40 (e.g., with the surface of the shelf oriented left-to-right). In some embodiments, the working position may encompass any position of the shelf in the longitudinal direction A (e.g., any sliding position) in which the shelf is generally parallel to the longitudinal direction. As used herein, the term "generally" when used in combination with orientations or dimensions, such as "generally parallel," does not require the receiving surface of the shelf to be parallel in a mathematically precise position and is meant to indicate that the shelf is within a moderate range of deviation from absolutely parallel that is commonly acceptable as a level of accuracy for these terms within dishwashing arts.

The stowed position may be defined farther from parallel to the longitudinal direction than the working position. In such embodiments, the receiving surface 16 of the shelf 14 may be pivoted out of alignment with the longitudinal direction when transitioning from the working position to the stowed position. With continued reference to FIG. 4, the shelf 14 is shown pivoting about the rear engagement portion 34 and attachment member 50 between the working and stowed positions. In such embodiments, the shelf 14 may be lifted from the second side and may pivot relative to the pivotal attachment members 50 on the engaging portions 32, 34 of the first side.

In the depicted embodiment, the receiving surface 16 of the shelf 14 is generally perpendicular to the longitudinal direction in the stowed position. In some embodiments, the shelf 14 may be slid to the rear wall 44 in the stowed position to avoid obstructing the dishwasher rack 8. Said differently, the shelf 14 may be slid until the receiving surface 16 is adjacent to an end of the first wall and an end of the second wall (e.g., the left end relative to the page in FIG. 4). For example, in the stowed position, the receiving surface 16 of the shelf 14 may be pivoted generally perpendicular to the longitudinal direction and slid at least to the longitudinal position of the rear wall 44 (e.g., to the end of the first wall 38 and the second wall 40). The rear wall 44 may extend between the end of the first wall 38 and the end of the second wall 40.

In some embodiments, the rear wall 44 and the receiving surface 16 of the shelf 14 may be generally parallel in the stowed position, and in some further embodiments, the rear wall 44 and the receiving surface 16 of the shelf 14 may be generally coplanar in the stowed position. In some other embodiments, the upper edges of the walls 18, 20, 22, 24 may be generally coplanar with the rear wall 44 in the stowed position. In each of the embodiments discussed above, the receiving surface 16 of the shelf 14 may be said to be adjacent the ends of the walls on which the cutlery rack slides. In some embodiments, the shelf may slide past the rear wall 44 (e.g., farther into the wash chamber 4 behind the dishwasher rack 8 and past the ends of the walls). The shelf 14 may rest against the rear wall 44 and/or the side walls 38, 40 of the dishwasher rack 8 in the stowed position.

In some embodiments, the receiving channel 52 of the rail 48 may terminate at a distance equal to the length L from the rear wall 44. In such embodiments, the cutlery rack 12 may be limited from sliding closer than the length L from the rear wall 44 in the working position, and thus, the shelf 14 may be generally coplanar with the rear wall 44 in the stowed position because the engaging portions 28, 30, 32, 34 may also define a length L.

In some embodiments described herein, a method of manufacturing a dishwasher with a cutlery rack may be provided. The dishwasher may include a dishwasher rack removably disposed in the dishwasher. The dishwasher rack may include at least a first wall, a second wall, and a third wall (e.g., first side wall 38, second side wall 40, and rear wall 44, respectively, in the embodiment depicted in FIGS. 1-4). The first wall may be parallel to the second wall, and the third wall may extend between the first wall and the second wall. A cutlery rack may be provided that includes a first engaging portion, a second engaging portion, and a shelf extending between the engaging portions. The method may include attaching the first engaging portion of the cutlery rack to the first wall of the dishwasher rack. After attachment, the first engaging portion may be configured to slide relative to the first wall of the dishwasher rack. The method may further include attaching the second engaging portion of the cutlery rack to the second wall of the dishwasher rack. After attachment, the second engaging portion may be configured to slide relative to the second wall of the dishwasher rack. The shelf may slide in a longitudinal direction with respect to the first wall and the second wall. The shelf may be configured to pivot with respect to the dishwasher rack between the working position and the stowed position. In the working position, the shelf may be disposed closer to parallel with the longitudinal direction than in the stowed position, and in the stowed position, the shelf may slide at least to a longitudinal position of the third wall of the dishwasher rack.

With reference to FIG. 4, the cutlery rack 12 may be positioned sufficiently close to the top wall of the wash chamber 4 that the rack 12 impinges the top wall during folding between the working position and the stowed position, while allowing the cutlery rack 12 to not impinge the top wall when in the final working and stowed positions. In such embodiments, the cutlery rack may be pivoted between the working position and folded position only when the cutlery rack and dishwasher rack are slid out from the wash chamber 4. For example, in some embodiments, the rails 48 of the dishwasher rack 8 may be positioned less than 6.18 inches and greater than 4.88 inches from the top of the wash chamber 4, such that for example in embodiments in which the length L is approximately 3.78 inches and the width of the shelf 14 is approximately 4.88 inches, the cutlery rack 12 may be approximately from 1.1 inches to 2.4 inches from the top of the wash chamber in the working position and approximately from zero inches to 1.3 inches from the top wall of the wash chamber in the stowed position.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. While some drawings and description may omit features described elsewhere for simplicity of explanation, it is understood that these features may nonetheless be present in any of the embodiments in any combination or configuration, as detailed above. Although specific terms are employed herein, they are used in a generic and descriptive sense only and not for purposes of limitation.

The invention claimed is:

1. A dishwasher comprising:

a dishwasher rack disposed in the dishwasher, the dishwasher rack comprising at least a first wall extending in a longitudinal direction and a second wall extending in the longitudinal direction, wherein the first wall is parallel to the second wall and spaced from the second wall in a lateral direction that is perpendicular to the longitudinal direction, and wherein each of the first wall and the second wall defines at least one end; and a cutlery rack comprising:

a first engaging portion slidably attached to the first wall of the dishwasher rack;

a second engaging portion slidably attached to the second wall of the dishwasher rack;

a shelf extending between the first engaging portion and the second engaging portion, the shelf defining a receiving surface for receiving cutlery, wherein the shelf is configured to slide in the longitudinal direction with respect to the first wall and the second wall, and wherein the shelf is configured to pivot with respect to the dishwasher rack about an axis that is parallel to the lateral direction between a working position and a stowed position;

wherein in the working position, the receiving surface of the shelf is aligned with the longitudinal direction, wherein in the stowed position, the receiving surface shelf is pivoted out of alignment with the longitudinal direction and positioned adjacent an end of the first wall and an end of the second wall, wherein the first engaging portion and the second engaging portion are disposed on a first side of the cutlery rack, wherein the first engaging portion defines a first pivotal attachment member engaging a first rail on the first wall of the dishwasher rack, and wherein the second engaging portion defines a second pivotal attachment member engaging a second rail on the second wall of the dishwasher rack; and a second side comprising a third engaging portion configured to be removably and slidably disposed on the first rail in the working position and a fourth engaging portion configured to be removably and slidably disposed on the second rail in the working position, wherein the cutlery rack is configured to slide along the first rail on the first engaging portion and the third engaging portion and the cutlery rack is configured to slide along the second rail on the second engaging portion and the fourth engaging portion; and wherein the cutlery rack is configured to be pivoted to the stowed position by lifting the second side of the cutlery rack and rotating the cutlery rack about a first pivotal attachment member of the first engaging portion and a second pivotal attachment member of the second engaging portion.

2. The dishwasher according to claim 1, wherein in the working position, the receiving surface of the shelf is configured to be disposed generally parallel to the longitudinal direction.

3. The dishwasher according to claim 1, wherein in the stowed position, the receiving surface of the shelf is configured to be disposed generally perpendicular to the longitudinal direction.

4. The dishwasher according to claim 1, wherein the first wall further comprises a first rail disposed on an upper edge of the first wall, the first rail at least partially defining a first receiving slot, wherein the first receiving slot extends parallel to the longitudinal direction, and wherein the first engaging portion is configured to engage the first receiving slot.

5. The dishwasher according to claim 4, wherein the first engaging portion comprises a first leg attached generally perpendicular to the shelf, the first leg defining a respective length, wherein the first receiving slot terminates at a distance from the end of the first wall of the dishwasher rack, and wherein the distance is equal to the respective length of the first leg.

6. The dishwasher according to claim 4, wherein the second wall further comprises a second rail disposed on an upper edge of the second wall, the second rail at least partially defining a second receiving slot, wherein the second receiving slot extends parallel to the longitudinal direction, and wherein the second engaging portion is configured to engage the second receiving slot.

7. The dishwasher according to claim 6, wherein the second engaging portion comprises a second leg attached generally perpendicular to the shelf, the second leg defining a respective length that is equal to the respective length of the first leg, wherein the second receiving slot terminates at the distance from the end of the second wall of the dishwasher rack.

8. The dishwasher according to claim 1, wherein the cutlery rack further comprises a third engaging portion attached to the shelf and a fourth engaging portion attached to the shelf, wherein the third engaging portion is configured to engage the first wall in the working position, and wherein the fourth engaging portion is configured to engage the second wall in the working position.

9. The dishwasher according to claim 1, wherein the first engaging portion defines a first slot configured to receive at least a portion of the first wall therein, and wherein the first engaging portion further comprises a first attachment member extending across the first slot, such that the first engaging portion at least partially surrounds the portion of the first wall.

10. The dishwasher according to claim 9, wherein the second engaging portion defines a second slot configured to receive at least a portion of the second wall therein, and wherein the second engaging portion further comprises a second attachment member extending across the second slot, such that the second engaging portion at least partially surrounds the portion of the second wall.

11. The dishwasher according to claim 10, wherein the axis extends between the first attachment member and the second attachment member.

12. The dishwasher according to claim 1, wherein in the stowed position, a portion of the shelf is configured to rest on an upper edge of a third wall of the dishwasher rack, and wherein the third wall extends between the end of the first wall and the end of the second wall.

13. The dishwasher according to claim 1, wherein the shelf, the first engaging portion, and the second engaging portion are fixedly connected to each other, and wherein the axis extends between the first engaging portion and the second engaging portion.

14. The dishwasher according to claim 1, wherein the axis lies in a plane parallel to the lateral direction and extends between the first engaging portion and the second engaging portion throughout a range of sliding movement of the cutlery rack in the longitudinal direction.

* * * * *